US007410418B2

(12) United States Patent
Potter

(10) Patent No.: US 7,410,418 B2
(45) Date of Patent: Aug. 12, 2008

(54) CHESS-LIKE GAME INVOLVING HIDDEN INFORMATION

(76) Inventor: David Graham Potter, 30 Glenarden Road, Toronto, Ontario (CA) M6C 3K2

( * ) Notice: Subject to any disclaimer, the term of this patent is extended or adjusted under 35 U.S.C. 154(b) by 322 days.

(21) Appl. No.: 11/167,106

(22) Filed: Jun. 28, 2005

(65) Prior Publication Data

US 2007/0013131 A1 Jan. 18, 2007

(51) Int. Cl.
*A63F 3/02* (2006.01)

(52) U.S. Cl. ..... 463/14; 273/260

(58) Field of Classification Search ..... 463/14; 273/260

See application file for complete search history.

(56) References Cited

U.S. PATENT DOCUMENTS

| | | | |
|---|---|---|---|
| 5,957,455 | A | 9/1999 | Aldridge |
| 6,203,016 | B1 | 3/2001 | Frommer |
| 6,402,146 | B1 | 6/2002 | Goller |
| 6,585,264 | B2 | 7/2003 | Benett |
| 6,702,287 | B1 | 3/2004 | Pendexter |
| 6,799,763 | B2 | 10/2004 | Grady |
| 6,830,513 | B1 | 12/2004 | Ballard |

OTHER PUBLICATIONS

Fog of War Chess by William Lee Sims—http://www.chessvariants.org/other.dir/fog_of_war_chess.html.*

Kung Fu Chess by Shimzoo Games—http://www.chessvariants.com/large.dir/kungfuchess.html.*

Kung Fu Chess by Shimzoo Games -http://www.shizmoo.com.*

Wikipedia—Chess Variants—http://en.wikipedia.org/wiki/Chess_variant.*

Dark Chess—http://en.wikipedia.org/wiki/Dark_Chess.*

Jan Kuylenstierna et al., The Value of Information in War: Some Experimental Findings. Published in 2000. Found at http://www.dodccrp.org/events/2000/5th_ICCRTS/cd/papers/Track1/014.pdf.

* cited by examiner

*Primary Examiner*—John M Hotaling, II
*Assistant Examiner*—Damon Pierce
(74) *Attorney, Agent, or Firm*—Integral Intellectual Property Inc.; Miriam Paton

(57) ABSTRACT

A chess-like game involves hidden information. The information provided to a player of the game includes positions and types of game pieces on a) squares that are occupied by game pieces belonging to the player and squares that are diagonally adjacent thereto, b) squares to which one or more of the game pieces belonging to the player can move according to their respective movement patterns and which are not occupied by an enemy game piece and squares that are diagonally adjacent thereto, and c) squares occupied by enemy game pieces that can be captured or put into check by one or more of the game pieces belonging to the player can move according to their respective movement patterns. The information excludes positions and types of game pieces on any other squares. The game may also involve non-alternating moves.

14 Claims, 5 Drawing Sheets

CHESS-LIKE GAME INVOLVING HIDDEN INFORMATION

COPYRIGHT NOTICE

A portion of the disclosure of this patent document contains material which is subject to copyright protection. The copyright owner has no objection to the facsimile reproduction by anyone of the patent document or patent disclosure, as it appears in the Patent and Trademark Office patent file or records, but otherwise reserves all copyright rights whatsoever.

BACKGROUND OF THE INVENTION

Traditional Western chess is a popular game. However, some players look to variants of chess in search of additional challenges. These variants, many of which are described at the Chess Variants website www.chessvariants.org, may involve new game pieces, different boards, more than two players, incomplete information, and or other changes from traditional Western chess.

Some chess variants involving incomplete information, for example, Kriegspiel, are played with the assistance of a referee, while other chess variants involving incomplete information, for example, Fog of War chess, are played as a computer application.

In the Dark Chess variant described at www.itsyourturn-.com/t _helptopic2020.html#helpitem1275, a player can only see a space on the board if the player has a game piece on that square, the player can move a game piece to that square, the square is directly in front of one of the player's pawns, or the square is an adjacent forward diagonal from one of the player's pawns.

In the Kung Fu Chess variant, players are not required to alternate moves. Players move and capture game pieces in realtime. Game pieces take time to move to their destinations and must rest before receiving their next orders.

BRIEF DESCRIPTION OF THE DRAWINGS

Embodiments of the invention are illustrated by way of example and not limitation in the figures of the accompanying drawings, in which like reference numerals indicate corresponding, analogous or similar elements, and in which.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION OF EMBODIMENTS OF THE INVENTION

The following description is of a chess-like game. Although the game is described relative to traditional Western chess, it is obvious to a person of ordinary skill in the art how to modify the game for many variants of chess.

The chess-like game involves hidden information. A referee maintaining a game board with the complete information may assist players to play the chess-like game. Alternatively, the game may be played as a computer application.

Figure 1:
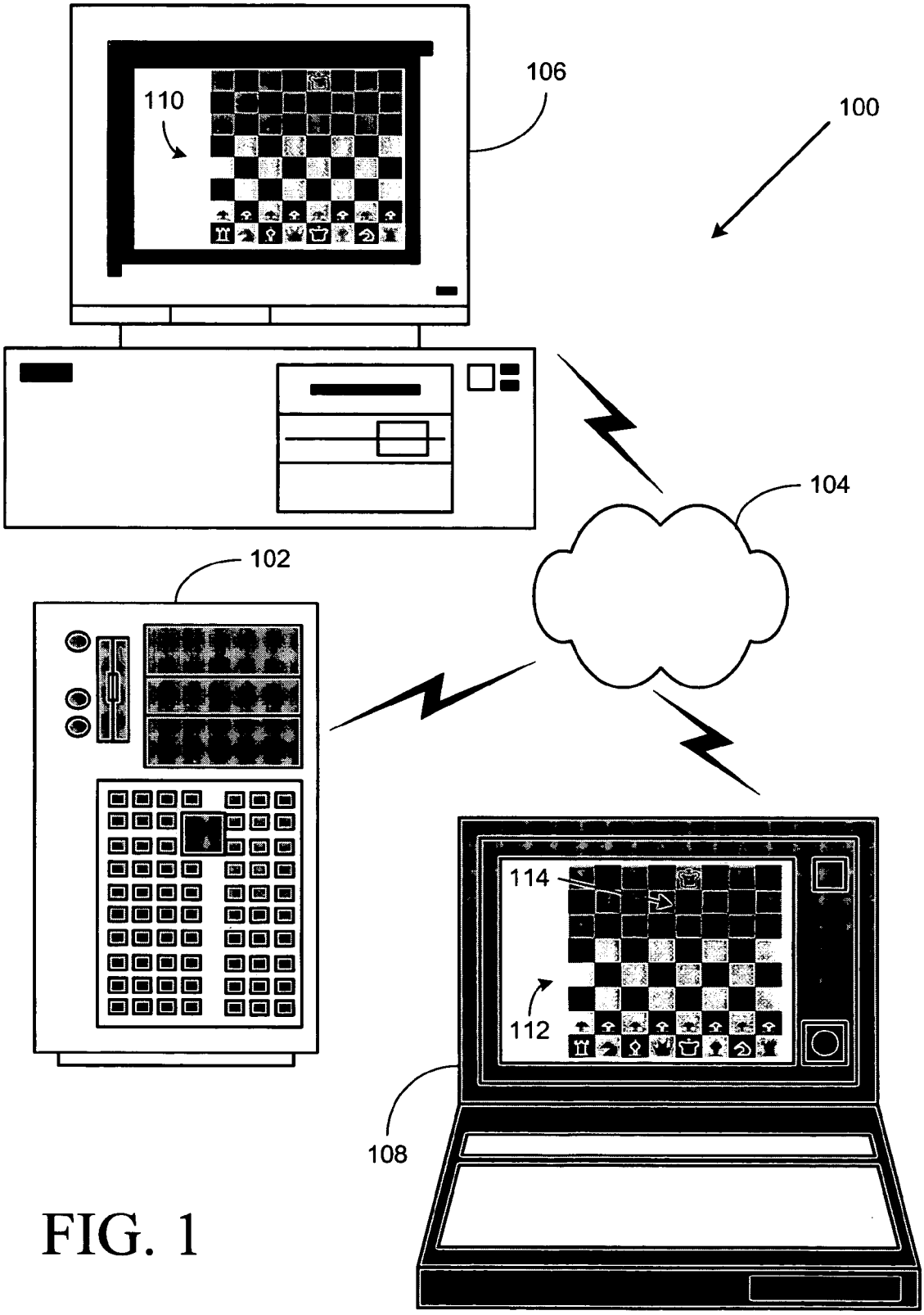
FIG. 1 is a schematic illustration of an exemplary computer system according to some embodiments of the invention.

A client-server implementation of the game to be played over a data network is described, but other computer-based implementations are also contemplated. FIG. 1 is a schematic illustration of an exemplary computer system 100 according to some embodiments of the invention. A server 102 runs a server application that manages the game and communicates via a data network 104, for example, the Internet, with applications running on client computers 106 and 108 used by two different players. The server application may manage two or more games concurrently.

Players are provided with information about the game. In the case of a refereed game, a referee may have complete information about the game, and may control how much of that information is provided to each player at any given time. The information may be provided by the placement of game pieces on a game board, or through notation, for example, algebraic notation or figurine notation.

In the case of a computer application, an image of the positions and types of game pieces on a game board may be displayed to the player. For example, an image 110 may be displayed on client computer 106 and an image 112 may be displayed on client computer 108. In the example shown in FIG. 1, images 110 and 112 are identical, because the game has yet to begin, and in this embodiment, each player is displayed an image as if the player is playing "white". However, after one of the players makes a move, the images displayed to the players would no longer be identical.

The following description is for a game in which both players are provided with information according to the same fixed criteria. However, another possibility is that one player is provided with complete information, while the other player has incomplete information according to some fixed criteria. Yet another possibility is that one player is provided with incomplete information according to one set of fixed criteria, while another player is provided with incomplete information according to a different set of fixed criteria.

The information provided to a player about the game may include positions and types of games pieces on a) squares that are occupied by game pieces belonging to the player and squares that are diagonally adjacent thereto, b) squares to which one or more of the game pieces belonging to the player can move according to their respective movement patterns and which are not occupied by an enemy game piece and squares that are diagonally adjacent thereto, and c) squares occupied by enemy game pieces that can be captured by one or more of the player's game pieces according to their respective movement patterns.

The information provided to the player about the game may exclude positions and types of game pieces on any other squares.

In other words, a player is provided with information about the game through the "eyes" of the uncaptured game pieces belonging to the player. Squares 114 that the game pieces belonging to the player cannot see may be displayed in less intense shades and appear to be empty even if they actually contain game pieces belonging to the player's opponent.

The field of vision of a game piece is extensive. From the middle of an empty standard chessboard, a queen can see 52 of the 64 squares; a rook, 39; a bishop, 30; a knight, 29; a king, 25; and a pawn, 10. Each game piece's field of vision includes its movement pattern and an envelope of diagonally adjacent squares, so that the field of vision includes:

a) enemy game pieces blocking its moves;
b) enemy game pieces it can capture or the enemy king if it is in check;
c) enemy pawn threats;
d) enemy pawns guarding squares to which it can move; and
e) the enemy king if it is in check, closely blockaded, or guarding a square to which the player could move a closely blockading game piece, for example, a rook blockading the enemy king from an adjacent rank or file.

Figure 2:
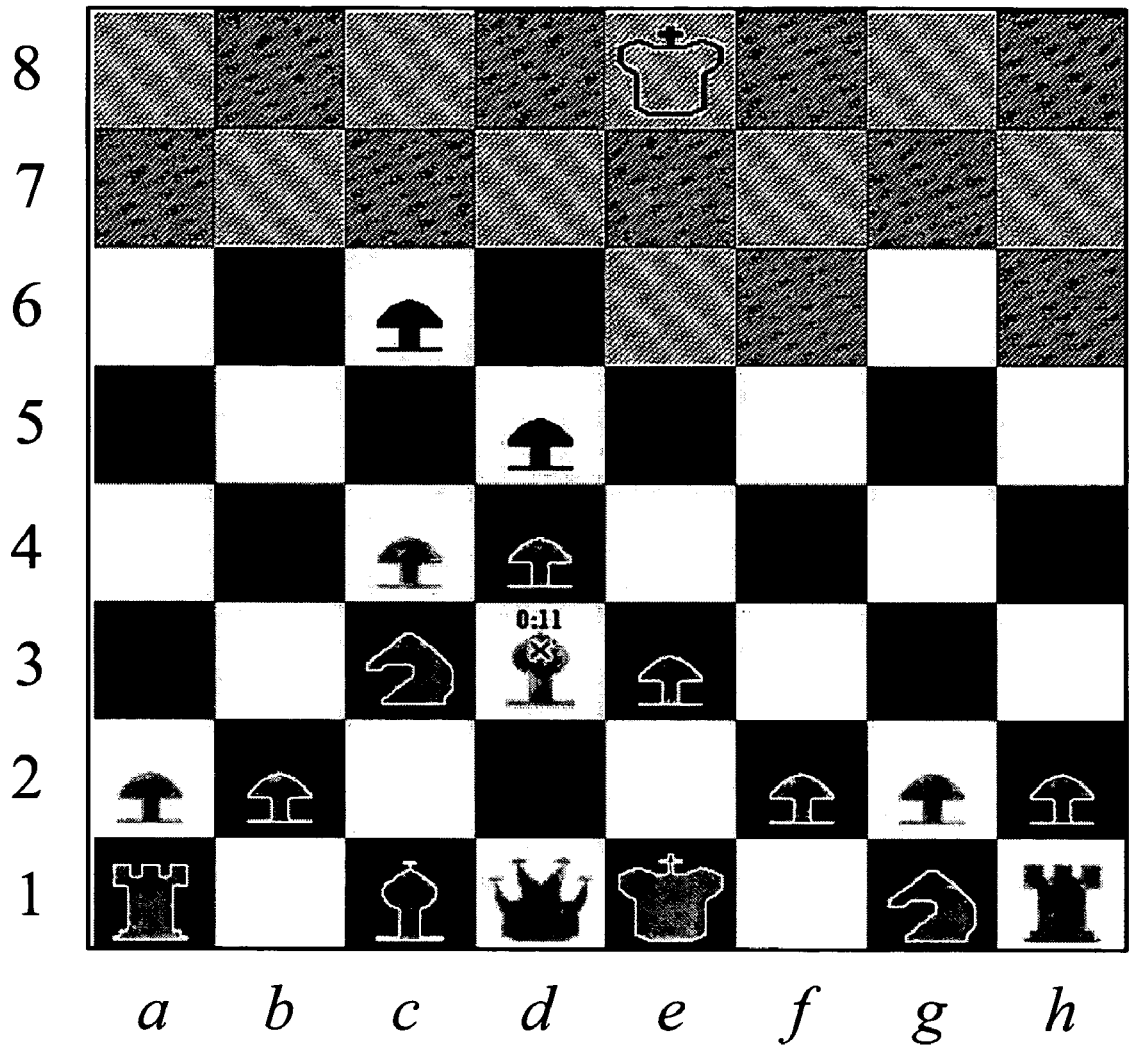
FIG. 2 is an exemplary image of the positions and types of game pieces on a game board that are displayed to a player at a particular point in a game, according to some embodiments of the invention.

FIG. 2 is an exemplary image of the positions and types of game pieces on a game board that are displayed to a player at a particular point in a game, according to some embodiments of the invention. The player has white game pieces and the opponent has black game pieces. In this exemplary image, the black pawn at c6 is visible because c6 is diagonally adjacent to b5, and the white knight at c3 is able to move to b5. Therefore, c6 is in the field of vision of the white knight at c3. Similarly, the black pawn at d5 is visible because the white knight at c3 and the white pawn at c4 can both move to d5;

the white pawn at c4 is diagonally adjacent to d5; and the white knight at c3 and the white pawn at e3 can both move to e4 and e4 is diagonally adjacent to d4.

In some embodiments of the invention, the game also involves enabling any of the players to make two or more consecutive moves in the game without an intervening move by another of the players. Moves need not be alternating as in traditional Western chess. However, the game retains the instantaneous move of chess; in contrast with some other real-time strategy games, game pieces do not move over a period of time interacting with each other as they move.

In order to preserve chess tactics and endgame techniques, these embodiments of the game also involve minimum and maximum time restrictions on moves by a single player. The time remaining before these time restrictions apply or cease to apply is communicated to the player. Effectively, the minimum and maximum time restrictions amount to a relaxed form of the alternating move rule of traditional Western chess.

The referee or computer application delays performance of a move by a particular player until at least a predetermined minimum period of time has elapsed since a most recent legal move by the particular player. This aspect of the game enables a player to prevent the opponent from making two moves in a row. For example, the predetermined minimum period of time may be 30 seconds. If one player moves at 30:00 and again at 30:30, the opponent cannot fit in two moves in the 30 seconds between the player's moves. During an exchange or other combination, two players may move quickly to prevent each other from making two moves in a row, and therefore, they alternate moves. By allowing the players to force moves to alternate in this way, chess tactics are preserved.

When the players see each other's moves, they can move somewhat more slowly, every 60 seconds instead of every 30 seconds, while still preventing each other from making two moves in a row. For example, if a player moves at 30:00 and the opponent sees the player's move, the opponent may wait until 30:30 to move. If the player sees the opponent's move, the player may wait until 31:00 to move again, and so on.

The referee or computer application terminates the game at a loss to a specific player if more than a predetermined maximum period of time has elapsed since a most recent legal move by the specific player. This aspect of the game allows a player to force the opponent to move in turn because, after the player has moved, the opponent's maximum time limit will expire sooner than the player's. For example, the predetermined maximum period of time may be 4 minutes.

In other embodiments, the predetermined minimum period of time between moves by the same player may be 7.5 seconds, 15 seconds, 30 seconds, or any other suitable period of time. Similarly, the predetermined maximum period of time may be 1 minute, 2 minutes, 4 minutes, or any other suitable period of time. The players may be able to select the predetermined minimum period of time and the predetermined maximum period of time, and/or the ratio therebetween.

Figure 3:
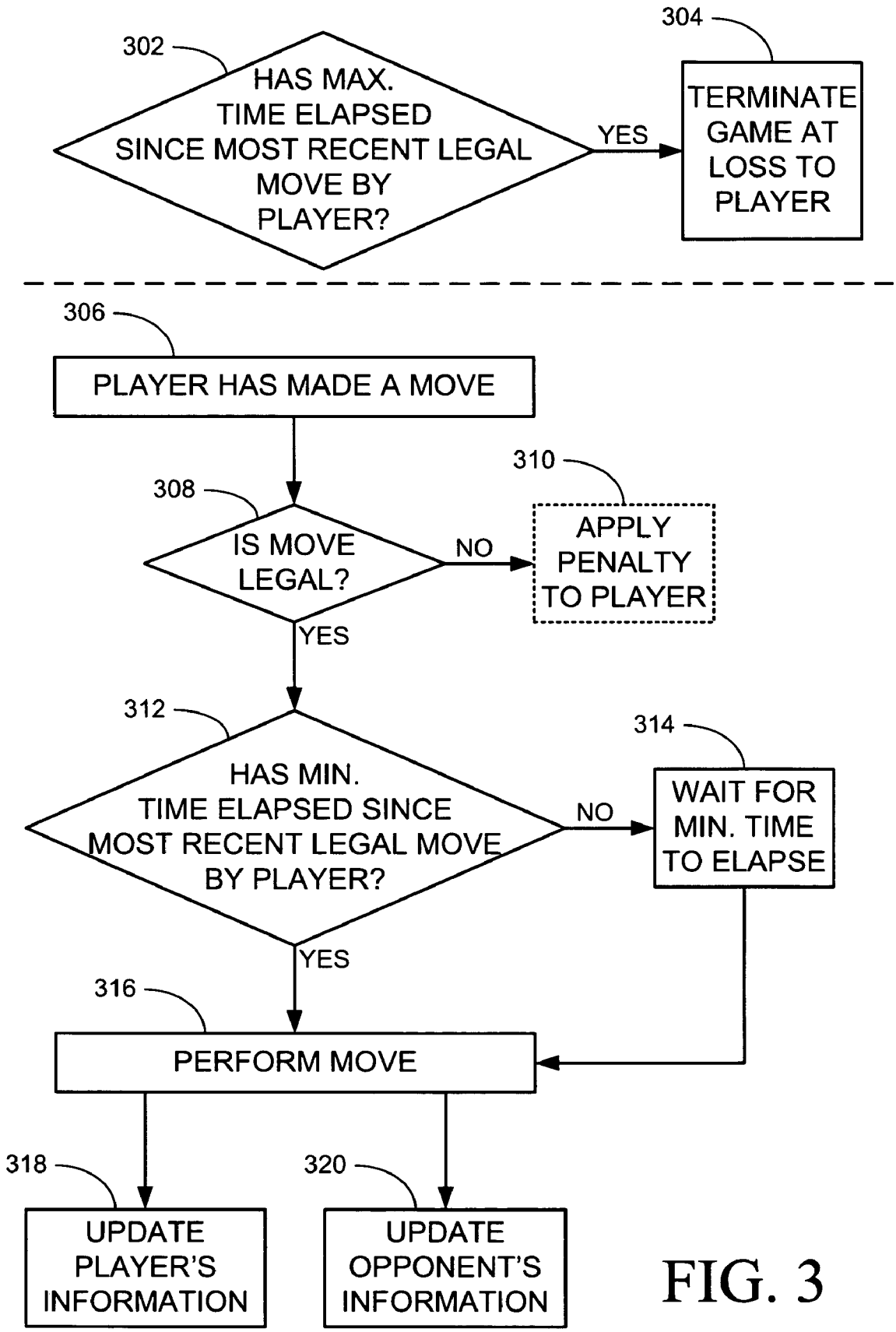
FIG. 3 is a simplified flowchart of an exemplary method for moves within time limits, to be implemented by a computer application running a chess-like game, according to some embodiments of the invention.

FIG. 3 is a simplified flowchart of an exemplary method to be implemented by a computer application running a chess-like game, according to some embodiments of the invention.

Throughout the game, it is checked (as at 302) whether the predetermined maximum period of time has elapsed since the most recent legal move by the player. This is checked using, for example, timers and event queues. If it has elapsed, then at 304 the game is terminated at a loss to the player.

Once a player has made a move at 306, it is checked at 308 whether the move is legal. If it is not legal, then at 310 a penalty may optionally be applied to the player.

If it is a legal move, then at 312 it is checked whether the predetermined minimum period of time has elapsed since the most recent legal move by the player. If it has not elapsed, then at 314 the move is suspended until the predetermined minimum period of time has elapsed. If the predetermined minimum period of time has elapsed, the move is performed at 316. The information provided to the player and the opponent is updated accordingly at 318 and 320, respectively. If the player's opponent moves while the method is waiting for the predetermined minimum period of time to elapse at 314, the player's move is cancelled.

In some embodiments of the invention, the game also involves a tradeoff between initiative and the availability of information. Upon performing a move of a particular game piece by the player, the referee or computer application temporarily excludes positions and types of game pieces on certain squares from the information for a duration that depends on a rate of play of the player. The squares for which positions and types of game pieces are excluded from the information provided to the player are the squares that are within the field of vision of the particular game piece that was moved, provided they are not in the field of vision of another game piece that retains its field of vision.

For example, in the exemplary image shown in FIG. 2, the white bishop at d3 is marked with an X since it has lost its field of vision (i.e. cannot see) and 11 seconds remain until it regains its field of vision. Therefore, although the white bishop at d3 can move to h7, the square at h7 is hidden from the player having the white game pieces. Similarly, although the white bishop at d3 can move to f5 and f5 is diagonally adjacent to e6, the square at e6 is hidden from the player having the white game pieces. Similarly, although the white bishop at d3 can move to g6 and g6 is diagonally adjacent to f7, the square at f7 is hidden from the player having the white game pieces. Since g6 is in the field of vision of the white bishop at d3, it might seem that it too ought to be hidden from the player having the white game pieces. However, g6 is in the field of vision of the white queen at d1, so g6 remains visible to the player having the white game pieces. So do several other squares in the field of vision of the white bishop at d3, which are in the fields of vision of other white game pieces.

The basis of this tradeoff is that all moves cost information, and the loss of information increases dramatically as the player moves more quickly. So if a player moves too quickly, the opponent lets the player take the initiative, but the player gives up too much information. If a player moves too slowly, the opponent will take the initiative, giving up too little information in return. Players may choose to play at a rate that balances the benefit of the initiative against its cost in information. The decision of how quickly to play depends on the player's assessment of the relative values of the initiative and the information in each situation. This assessment is a matter of judgment, and so the tradeoff between initiative and information tests the strategic vision of the player. In fact, the relevant factors for assessing the tradeoff include not just the value of the initiative and the value of information in general, but also the contribution to each player's information by the game pieces likely to be involved in the next move, in the reply, or in an ensuing combination.

As an exception to this rule of temporary loss of information, a game piece can always see the enemy king if in its field of vision, even if the game piece temporarily cannot see. This exception ensures that in an endgame against the lone enemy king, one's queen, rook or pair of bishops can see the enemy king in order to force checkmate, regardless of one's rate of play.

In some embodiments, the duration D of the temporary exclusion of information is given by a formula $D=2^X$, where X=AN−BT−C, A, B and C are constant numbers, N represents the total number of moves made by the player in the game (including the current move), and T represents the time that has elapsed since the start of the game. Exemplary values for A, B and C are 2, 1, and 10, respectively, with T measured in minutes.

Some of the implications of the formula $D=2^{2N-T-10}$ are as follows:

for an individual move:

- for every minute a player delays making a move, the recovery time from the temporary exclusion of information is halved;
- the cost of taking the initiative when both players have made the same number of moves is a 41% greater recovery time for a player than for the player's opponent (assuming that the opponent sees the player's move and waits 30 seconds to reply) (T is 0.5 less for the player than for the player's opponent, so the player's recovery time is higher by a factor of $2^{1/2}$, or about 41%);
- the cost of taking the initiative when a player has already made one move more than the player's opponent is a recovery time that is greater than that of the player's opponent by a factor of 5.7 (assuming that the player's opponent sees the player's move and waits 30 seconds to reply) (for the player, N is 1 more and T is 0.5 less than for the player's opponent, so for the player, 2N−T is 2.5 more); for two moves more, it is greater by a factor of 22.6; for three moves more, by a factor of 90.6 and so on;

for a combination:

- the cost of keeping the initiative doubles every move (assuming that both players see each other's moves and choose to move as slowly as once every 60 seconds) (2N−T increases by 2×1−1=1 each move);
- the opponent, by replying more quickly, would reduce a player's relative initiative cost for the current move but increase it for later moves of the combination;

for the game as a whole:

- a possible longterm rate of play is one move for each player about every two minutes; this is the rate that keeps average recovery times from drifting higher or lower (2N−T fluctuates around an average that remains constant over time);
- a possible pattern of play combines fast play during combinations (each player moving every 30 to 60 seconds), with slower play at other times to bring the average rate down to one move about every two minutes;
- the difference between a faster game and a slower game may occur in early play; in the faster game, players move more quickly at the beginning, resulting in a longer average recovery time (higher average value for 2N−T), and then both games may settle into the same average pace of one move about every two minutes, maintaining the differential in recovery times (leaving the difference in their average value of 2N−T roughly constant);
- for every one minute that one game is faster than another, recovery times are doubled (for any N, T is lower by 1);
- at the beginning of the game, the cost of faster play is much less (the −10 reduces recovery time very significantly for the first few moves, but fast play soon increases 2N−T enough to cancel out the −10);
- the rate of play may tend to an equilibrium that enhances the tradeoff between initiative and information; if the cost of taking the initiative is persistently and obviously too low, some players may play quickly, speeding up the game and increasing the cost; if it is too high, some players may decrease the cost by slowing down.

The duration may depend also on other factors. For example, the duration may be increased as a penalty for an illegal move.

Figure 4:
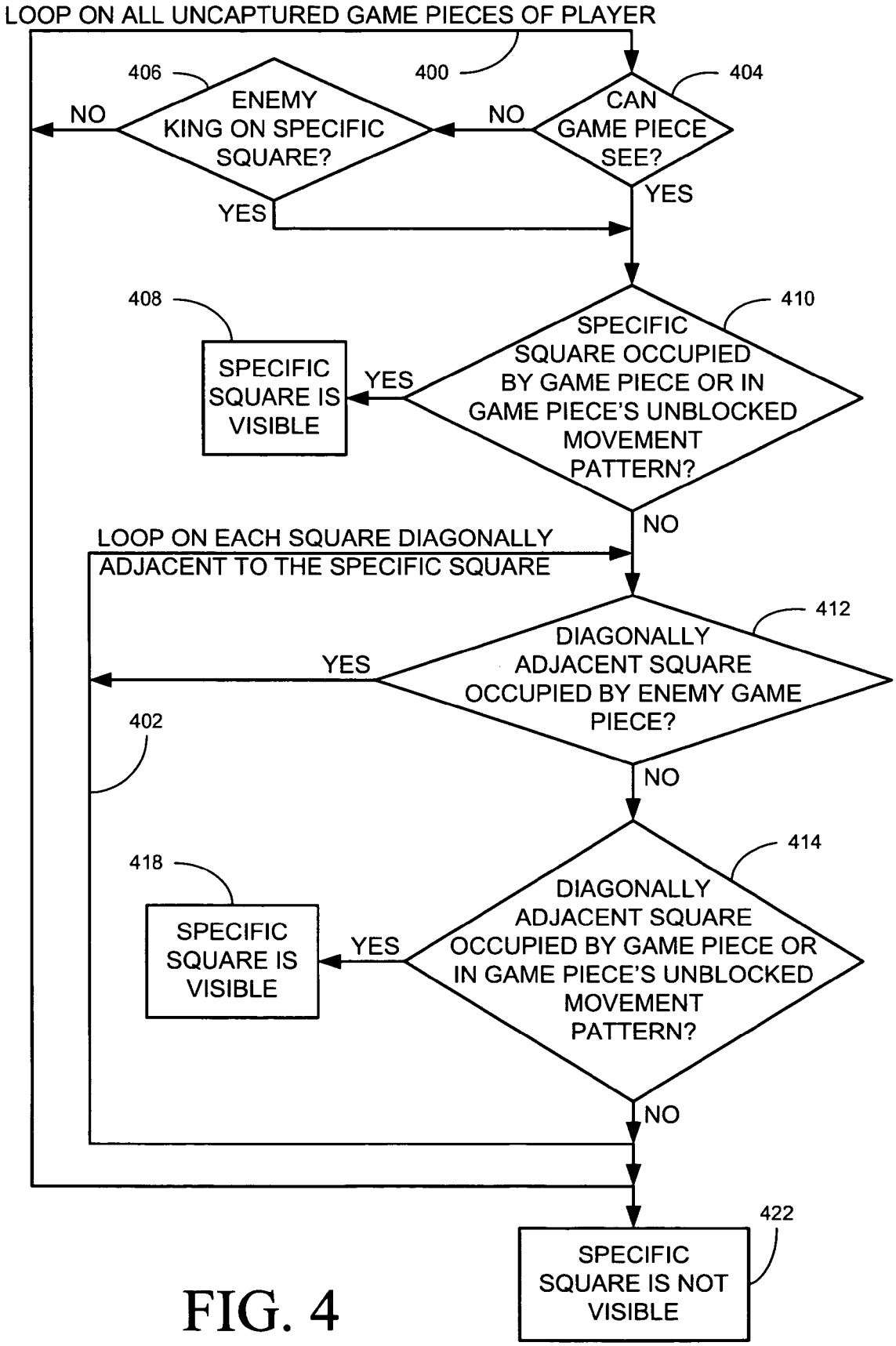
FIG. 4 is a simplified flowchart of an exemplary method for determining whether a specific square is visible to a player of a chess-like game, according to some embodiments of the invention.

FIG. 4 is a simplified flowchart of an exemplary method for determining whether a specific square is visible to a player of a chess-like game, according to some embodiments of the invention. The method of FIG. 4 begins with a loop 400 on all uncaptured game pieces of the player. Within loop 400 is a loop 402 on each square that is diagonally adjacent to the specific square.

At 404, it is checked whether the game piece can see (i.e. does not have a temporary loss of information applied thereto). If the game piece cannot see, it is checked at 406 whether the enemy king is on the specific square. If the enemy king is not on the specific square, then loop 400 is resumed for the next uncaptured game piece of the player.

If the game piece can see, or if the enemy king is on the specific square, then it is checked at 410 whether the specific square is occupied by the game piece or in the game piece's unblocked movement pattern. If so, then the specific square is deemed visible at 408, and the method ends. If the specific square is neither occupied by the game piece nor in the game piece's unblocked movement pattern, then loop 402 on each square that is diagonally adjacent to the specific square is performed.

At 412, it is checked whether the diagonally adjacent square is occupied by an enemy piece. If so, then loop 402 is resumed for the next square diagonally adjacent to the specific square. If not, then at 414, it is checked whether the diagonally adjacent square is occupied by the game piece or in the game piece's unblocked movement pattern. If so, then the specific square is deemed visible at 418 and the method ends. If the diagonally adjacent square is neither occupied by the game piece or in the game piece's unblocked movement pattern, then loop 402 is resumed for the next square diagonally adjacent to the specific square.

Once all the squares diagonally adjacent to the specific square have been checked via loop 402, loop 400 is resumed for the next uncaptured game piece of the player. Once all the uncaptured game pieces of the player have been checked via loop 400 without the specific square being deemed visible at 408 or 418, then the specific square is deemed not visible at 422.

Figure 5:
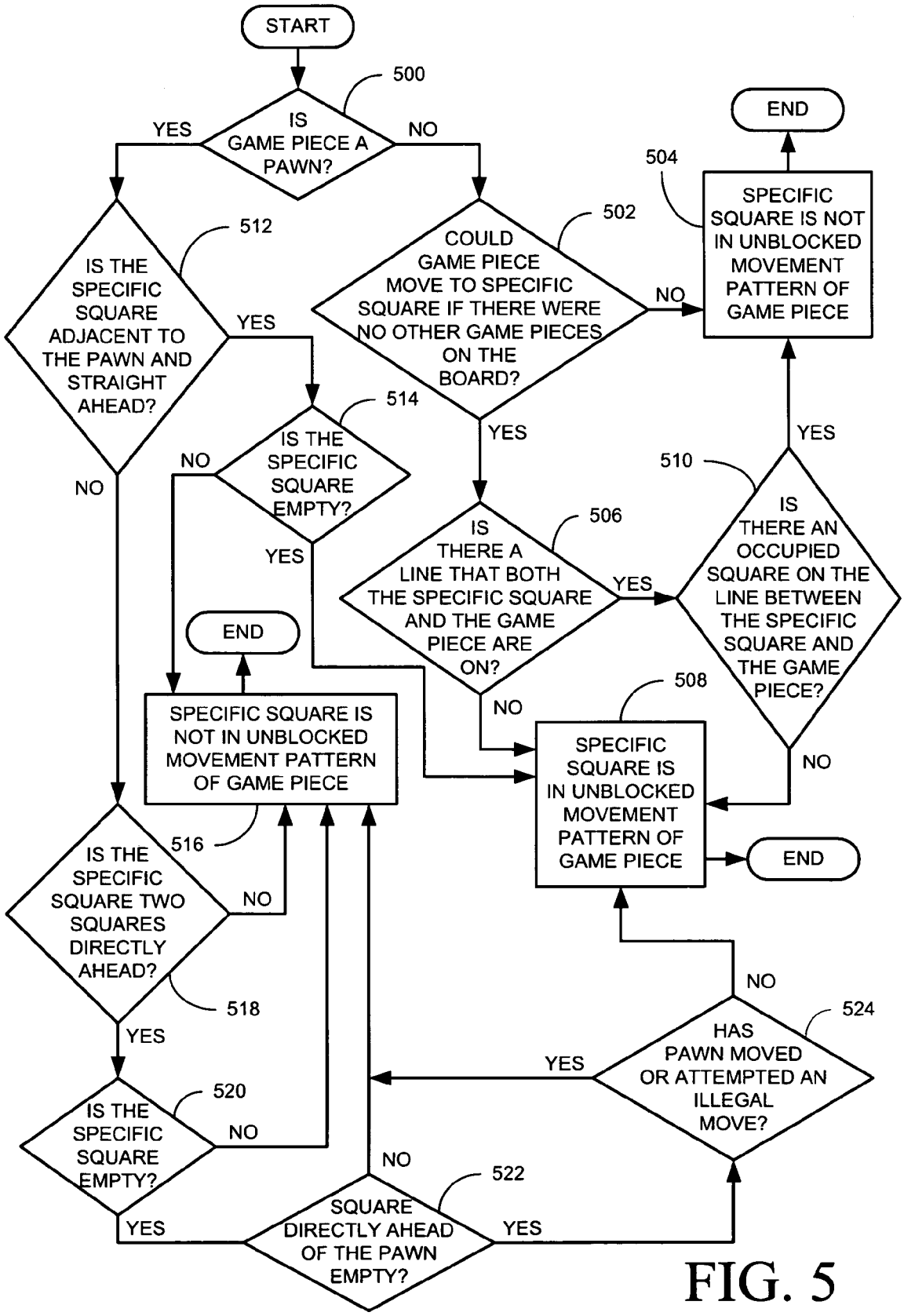
FIG. 5 is a simplified flowchart of an exemplary method for determining whether a specific square is in the unblocked movement pattern of a game piece, according to some embodiments of the invention.

FIG. 5 is a simplified flowchart of an exemplary method for determining whether a specific square is in the unblocked movement pattern of a game piece, according to some embodiments of the invention. The method of FIG. 5 may be used at 410 and 414 of the method of FIG. 4.

At 500, it is checked whether the game piece is a pawn. If not, then it is checked at 502 whether the game piece could move to the specific square if there were no other game pieces on the board (according to the rules of the game for that game piece). For example, in traditional chess, a rook can move only along the rank or file of the square which it occupies. If the game piece could not move to the specific square, then the specific square is deemed at 504 not in the unblocked movement pattern of the game piece, and the method ends. If the game piece could move to the specific square, then it is checked at 506 whether there is a line (rank, file, or diagonal) that both the specific square and the game piece are on. If not, then the specific square is deemed at 508 to be in the unblocked movement pattern of the game piece, and the method ends. If there is such a line, then it is checked at 510 whether there is an occupied square on the line between the specific square and the game piece. If so, then the specific square is deemed at 504 not in the unblocked movement pattern of the game piece, and the method ends. If not, then the specific square is deemed at 508 to be in the unblocked movement pattern of the game piece, and the method ends.

If the game piece is a pawn, then it is checked at 512 whether the specific square is adjacent to the pawn and straight ahead. If so, then if the specific square is empty (checked at 514), the specific square is deemed at 508 to be in the unblocked movement pattern of the game piece, and the method ends. If the specific square is not empty (checked at 514), the specific square is deemed at 516 not in the unblocked movement pattern of the game piece, and the method ends.

If the specific square is not adjacent to the pawn and straight ahead (checked at 512), then it is checked at 518 whether the specific square is two squares directly ahead. If not, then the specific square is deemed at 516 not in the unblocked movement pattern of the game piece, and the method ends. If so, then if the specific square is not empty (checked at 520), the specific square is deemed at 516 not in the unblocked movement pattern of the game piece, and the method ends. If the specific square is empty (checked at 520), then it is checked at 522 whether the square directly ahead of the pawn is empty. If not, then the specific square is deemed at 516 not in the unblocked movement pattern of the game piece, and the method ends. If empty, then it is checked at 524 whether the pawn has moved or has attempted an illegal move. If so, then the specific square is deemed at 516 not in the unblocked movement pattern of the game piece, and the method ends. If not, then the specific square is deemed at 508 to be in the unblocked movement pattern of the game piece, and the method ends.

Note that squares where a pawn can capture are in fact part of the unblocked movement pattern of the pawn, yet are not checked explicitly in the method of FIG. 5 since they are accounted for in the method of FIG. 4 as diagonally adjacent to the square occupied by the pawn.

Additional rules that may be applied to the game in some embodiments of the invention are described in an appendix.

As mentioned above, the game may be implemented as a client-server computer application to be played over a data network. In one example, the data network includes the Internet, and the computer application involves HTTP (Hypertext Transfer Protocol). The client-side of the application takes the form of scripts run by Web browsers on the players' computers (for example computers 106 and 108). The benefits of this approach for players are convenience and a good level of security. The server-side of the application emulates a web server.

In this example, the clients send the players' instructions to the server as HTTP requests. Most of these instructions are moves to make. Other instructions include pre-game opponent identification, resignations, and game preferences. The server sends information to the clients as HTTP responses. These responses include groups of detailed instructions to the client, for example to change the display for a particular square on the board, to change other information displayed to the player, or to update key variables used by the script.

The computer application adapts the standard HTTP request/response design to allow the server to initiate sending information to the clients. This is done, for example, when one player moves, and the other player needs to be informed. HTTP does not directly allow for server-initiated sending; it only allows servers to respond to client requests. To allow for server-initiated sending, the client scripts send "polling" requests as necessary so that they always have an outstanding request pending at the server. The server does not respond to these requests immediately, but holds them and responds if and when an event occurs that requires sending information to the client.

While certain features of the invention have been illustrated and described herein, many modifications, substitutions, changes, and equivalents will now occur to are intended to cover all such modifications and changes as fall within the spirit of the invention.

APPENDIX

The following Rules are for an exemplary embodiment of the invention. Other embodiments of the invention may have different rules.

1. The Laws of Chess, Articles 1,2,3 and 5, ("The nature and objectives of the game", "The initial position of the pieces on the chessboard", "The moves of the pieces", and "The completion of the game") apply except as otherwise specified in these rules.

2. You do not see the board directly or move your own men. Instead, you interact with the board through a server that administers the game. The server provides you with information and processes your moves and other instructions as specified by these rules.

3. You are not required to alternate moves with your opponent. Your moves must be at least 30 seconds apart. If you submit a move earlier than that, the server delays its execution until 30 seconds after your previous move. Your moves must be at most four minutes apart. If you do not move within that time limit, the server ends the game and you lose unless you are stalemated, in which case the game is a draw.

4. Information

4a. Fields of vision

A man's field of vision comprises:

the square it is in, and diagonally adjacent squares;

empty squares in its unblocked movement pattern, and diagonally adjacent squares;

except for a pawn, men it is guarding, and diagonally adjacent squares; and enemy men it is attacking (but not diagonally adjacent squares).

A pawn entitled to make an en passant capture is attacking the square it would move to in making the capture, and not the square the enemy pawn just moved to. The square it is attacking is not considered to be empty for purposes of this definition.

Diagonally adjacent squares are included to increase the availability of information in general, and to let you see enemy pawn threats and enemy pawns protecting your potential move destinations. Tracing through enemy men to diagonally adjacent squares is not included, to provide better concealment capabilities, especially for the king. For example, the king behind protective pawns is safe from detection as well as attack, but could be easily seen if opposing men could see it just by attacking one of its protective pawns. The reason that pawns are excepted from the third bullet above is to prevent the presence of one of your men from actually extending an enemy pawn's vision. If the guarded square were empty, it would not be in the pawn's movement pattern, and so the pawn could not see the diagonally adjacent squares. (The pawn can see the square itself whether it is occupied or not because of the first bullet). The reason for the special treatment of en passant capture squares is to make the capturing pawn's field of vision the same as it would be if the pawn being captured were actually in the capture square. Without this special treatment, the capturing pawn's field of vision would extend to squares diagonally adjacent to the capture square.

4b. Ability to see

Your men can see at the beginning of the game. When a man moves, it loses its ability to see for $22n-t-10$ minutes, where n is the number of moves you have made, including the current one, and t is the time at which you move, in minutes since the beginning of the game. If the man was already unable to see, the time it will take to recover its vision is extended by that amount. (For example, a seeing man makes your 9th move at time 7:00, and your 10th move at time 8:00. With the first move, it loses its ability to see for two minutes, and is scheduled to recover at 9:00. The second move adds 4 minutes to its recovery time, and so it is then scheduled to recover at 13:00.) For a castling move, the king and rook each incur half of the recovery time specified by the formula, and the castling move counts as just one move. A two square pawn advance is a single move like any other. When one of your unseeing men is captured, its remaining recovery time is transferred to your other unseeing men, in proportion to their existing recovery times. If all of your other men can see, the time is carried forward to be added to the recovery time of the next man you move. (The purpose of this adjustment is to preserve the tradeoff between initiative and information. For example, suppose you plan to play QxQ, forcing your opponent to recapture with KxQ 30 seconds later. Suppose that if you play immediately, your queen will incur 8 minutes of recovery time. Then the enemy king will incur 5.6 minutes of recovery time. If you delay for one minute, the recovery times will decrease to 4 minutes and 2.8 minutes respectively. If there were no adjustment of recovery time, you would be rewarded instead of penalized for playing immediately rather than delaying—you would not be affected by the higher recovery time for your queen, because it would disappear with the queen's capture, and you would benefit from the higher recovery time for the enemy king. To preserve the tradeoff between initiative and information, the recovery time incurred by the queen transfers to your other men instead of disappearing.)

4c. Your view of the board between moves

Between moves the server shows you:

your own men, and whether they can see;

enemy men in the field of vision of any of your men that can see;

the enemy king if it is in the field of vision of any of your men, whether or not they can see; and for your pawns that can see, whether the squares to which they can make normal moves are empty.

For enemy men, the server shows you only their type and location. (It does not show whether they can see or their precise identification; for example, you can't tell whether a rook you see is the king's rook or the queen's rook.) (The fourth bullet is relevant because pawns do not see enemy men that block their normal moves (see the diagrams illustrating fields of vision). This bullet tells seeing pawns whether the squares ahead are visible and empty, or whether they are invisible because of a blocking enemy man.)

4d. Your view of the board during moves (This rule specifies some additional information that you are entitled to during moves beyond a simple updating of your view of the board as specified in Rule 4c.) During each of your own moves, the server shows you the location of the enemy king if your moving man can see it from any square along its path. (The reason that other enemy men cannot be seen in this way is that your moving man loses its sight at the very beginning of its move.) During each of your opponent's moves, the server shows you the moving man in any square along its path in which it is visible, and the direction it is moving through the square. If the move is a capture, your man is removed after the arrival of the moving man in the capture square (so a seeing man captured normally (not en passant) sees the moving man arrive in the capture square), but before a pawn promotion. The path of knights and castling men consists of only the origin and destination squares, and the direction of their moves is straight up and straight down.

4e. Other information

The server shows you the approximate time of your moves and of opponent moves of which you are aware, and the exact order in which those moves occur. Definition: You are aware of a move by your opponent if you see any part of it or if it results in a change in your view of the board. (There are two types of changes in your view of the board that might result from an unseen opponent move: one of your men might disappear because of an unseen capture, and the enemy king might appear or disappear because of an unseen unblocking or blocking move.) The server also shows you at all times:

the current game time;

the scheduled recovery times for your men that cannot see;

at the server's discretion, player aids that summarize current and historical information to which you are entitled or that you could deduce. (These aids are a game history and a display of your opponent's remaining men.)

5. Moves (You move by interacting with your own computer, which sends your move instructions to the server. If you wish, you can instruct the server to hold your move for future execution. For example, your can schedule your move for just before your opponent can move again, just before your four-minute move deadline expires, or when the recovery time that will be incurred by the moving man has come down to a target amount. Between the time you start entering a move instruction and the time it is actually executed by the server, your opponent might move or one of your men might recover. This rule specifies the actions taken by the server in these cases. It also provides some protection for players with a slower connection to the server, or less dexterity in entering their move instructions. This rule also specifies what happens when you make an illegal move. For example, you might try to make a move that would leave your king in check by an unseen enemy man, or try to move an unseeing man through a blocking enemy man. This rule makes illegal moves very costly, in order to tilt the tradeoff between information and initiative toward more emphasis on information. It also adds a new requirement for a capture move to be legal—that you must correctly specify the type of man you are capturing. This requirement further tilts the tradeoff between information and initiative toward more emphasis on information. Finally, this rule specifies what happens when both players submit instructions for moves to occur at the same time.)

5a. Move instructions and processing 5a-1. You can submit a move instruction at any time that you do not already have one pending. Before the game begins, you can specify a move to be made at 0:00.

5a-2. A move instruction consists of:

the man to move;

the destination square;

the type of man, if any, you intend to capture (normally you do not have to specify this because your computer automatically adds a correct capture call to the move instruction it sends to the server; but if you are moving to an unseen square, and the move is not a pawn advance, then your computer will ask you for a capture call);

an optional pawn underpromotion instruction, if you are moving a pawn to the eighth rank; and an optional delay instruction. (This feature is used by player aids described in "How to Play" to give you convenient and precise control over the timing of your moves.)

5a-3. Except for the optional delay instruction, no component of a move instruction can be changed after it is specified. (This is a generalization of the chess rule that when you have touched a man you must move it.) The only change possible to the optional delay instruction is to remove it (so that your move will be executed as soon as possible). However, whenever your opponent makes a move of which you are aware, you are released from these obligations (so that you can take your opponent's move into account in making your next move). Your submitted move instructions are cancelled and any partially specified instructions are erased. (But if one of your men recovers while you have a move pending, you move is NOT cancelled. So you should consider waiting for upcoming recoveries before beginning a move.)

5a-4. When one of your men recovers its sight, the server will not act on any new instructions from you for 5 seconds. (It will act on any instructions it already has to make a move during that period.) If you send instructions within that period, it holds them for consideration at the end of the period. (The purpose of this rule is to equalize the speed with which players' can respond to new information, regardless of connection speed or dexterity.)

5b. Illegal moves

A move is illegal if it would be illegal in chess or the capture intention and result differ. An en passant capture is legal only for 30 seconds after your opponent's two square pawn advance. An illegal move results in no change in the position on the board, but is still considered a move for all purposes except meeting the four-minute move deadline of Rule 3. (So an illegal move is very costly. The moving man loses its ability to see and the move adds to all future recovery times. You cannot move again for 30 seconds and so your opponent could make two moves in a row in a possibly critical situation. You could also lose the game by failing to find a legal move within the four-minute move deadline. Note that because of this rule if a king or rook on its initial square makes an illegal move, a future castling move involving that man is illegal. Similarly, if a pawn on its initial square makes an illegal move, a future two square advance by that pawn is illegal, and the pawn's field of vision no longer extends to or through the second square ahead.) When your opponent makes an illegal move and the moving man is visible, the server shows you that an illegal move was attempted, but not the intended path or direction.

5c. Resolution of attempts by both players to move at the same time (Usually the first few moves of a game are simultaneous, with both players moving at exactly 0:00, 0:30, 1:00 and so on. This period of simultaneous moves ends when one player decides to slow down as the cost of fast play increases. It can also end with the server assigning priority to one move over another, to avoid undesirable interactions. When the server assigns priority to a move, it resolves the moves by executing the priority move first and the non-priority move second. This resolution process is instantaneous; both moves are executed at the same time, but they are no longer simultaneous from a tactical point of view. Once the initial period of simultaneous moves has been ended, there can never again be truly simultaneous moves. The players can still submit move instructions for execution at the same time, but the server always gives priority to one of the moves over the other. Specifically, it gives priority to the move of the player who did not make the last move. This ensures that the move will alternate, as in chess, throughout a period in which both players are moving as fast as they can.)

5c-1. When one move is assigned priority (Except for the calculation of recovery times, the priority move is treated as having been received earlier than the non-priority move.) If your move is assigned priority, the server executes it first. If your opponent's move is not cancelled (it is if your opponent sees your move), then the server executes it second, and the following rules apply: The same move time is used to calculate both moves' recovery times. (So all else being equal, both men will recover simultaneously.) If you see your opponent's move, the two moves are shown to you one at a time, in the order executed.

5c-2. When neither move is assigned priority

The result of the moves depends on whether there is interaction between them. The definition of interaction is based on this test: If the moves were made one at a time, would the order of execution make a difference to the position on the board? If so, there is interaction. For purposes of this test, making the moves consists only of: assessing the legality of the moves in accordance with the rules of chess; and moving the men on the board. If there is no interaction, the result of the moves on the board is what it would be if the moves were executed one at a time (in either order). If there is interaction, the result is that both moves become illegal. Here is an example:

| Time | You | Opponent |
|---|---|---|
| 0:00 | P-K4 | P-Q4 |
| 0:30 | PxP Becomes illegal | PxP Becomes illegal |

In this example, the first pair of moves does not interact, but the second pair of moves does. (If moves become illegal because of interaction and the players repeat the same moves 30 seconds later, then of course they are again illegal. It is unlikely that both players would continue this pattern for a full four minutes, because the recovery time cost would be more than two hours each for the moves made at 4:00, but if they did the game would end.) The same move time is used to calculate both moves' recovery times. (So all else being equal, both men will recover simultaneously.) If you see your opponent's move, both moves are shown to you together. In this case, the following clarifications (which concern rare situations) to Rule 4.d apply:

- your moving man loses its sight before detecting any simultaneous opponent move;
- your moving man can detect a moving enemy king at any square in the king's path from any square in the mover's path;
- in this case the direction of the king's move is also detected;
- the visibility of a moving enemy man along its path is assessed twice, once with your moving man still in its original square and once with it in its destination square, and the moving man is visible in a square if it is visible in either case.
- if you have a queen, rook or bishop in line with the origin square of one move and the destination square the other move, in either order with no other intervening men, then its field of vision through the origin square is unblocked before its field of vision is blocked through the destination square. (So your field of vision temporarily extends into squares further along the sight line (and squares diagonally adjacent to those squares, except the last one if it is enemy-occupied) and also into squares diagonally adjacent to destination square even if it is about to be occupied by an enemy man.)

5c-3. Assigning priority

The server assigns priority according to the first applicable criterion listed below. If none of the criteria apply, neither move is assigned priority. Your move is assigned priority if:

1. your opponent made the most recent move or, if both players last moved at the same time, the move that was not assigned priority.
2. you are trying to capture, with a pawn, a pawn that your opponent is trying to advance.
3. your opponent's move is an attempted capture and yours is not.
4. it is illegal, and your opponent's move is legal.
5. it is legal but would be illegal if executed second, and your opponent's move would be legal if executed second.

(The first criterion applies only after the initial period of truly simultaneous moves has ended. It ensures that players will alternate moves during a period of same-time moves by both players every 30 seconds. The other four criteria apply only during the initial period of truly simultaneous moves. When one of them applies, it ends that period by assigning priority. The purpose of all four is to prevent situations where both moves are cancelled because of interaction. In the situations addressed by criteria 2 and 5, the moves under consideration do interact. In the situation addressed by criteria 3 and 4, the moves under consideration may not interact, but there is a high probability of interaction on the next move (for criterion 3, as you try to recapture while your opponent tries to rescue his capturing man, and for criterion 4 because the illegal move likely indicates a complicated situation).

Priority is first assigned according to the principle that you should not achieve an unchesslike advantage during the transition from truly simultaneous moves to one-at-a-time moves. This principle applies to criteria 3 and 4. If criterion 3 were reversed, giving priority to your opponent's capture move, he would be able to make the capture before you had a reasonable chance to guard against the threat. If criterion 2 were reversed, giving priority to the passing move, your opponent would be able to pass the pawn without giving you a chance to capture. If criterion 4 were reversed, giving priority to your opponent's legal move, you would be rescued from the consequences of your illegal move if you saw your opponent's move, because your move would then be cancelled. In the following example, criterion 5 applies. Your opponent tries to pin a pawn at the same time you try to move it.

| Time | You | Opponent |
|---|---|---|
| 0:00 | P-K4 | P-K4 |
| 0:30 | P-Q3 priority, so "first" | B-N5 "second", gives check |

If criterion 5 were reversed, your move would be second, and would be illegal.)

6. Game ending conditions

6a. Automatic

This rule along with Rules 3 and 6.b modify several provisions of Article 5 of The Laws of Chess, "The completion of the game". The rule for checkmate applies without modification.) Stalemate does not occur except as specified in Rule 3 (that is, unless four minutes have passed during which one of the players has not made a legal move; as a result, you can put your opponent in a stalemate position, and relieve it with a later move without ending the game). If neither player has made a legal move for four minutes, then: if your last legal move had priority over your opponent's, you win; if neither player's last legal move had priority, the game is a draw. No game ending conditions require that the players make a claim (as some do in chess). In assessing whether a draw has occurred because of the third repetition of a position, the server will consider two occurrences as separate occurrences only if both players have made at least one intervening legal move. A draw occurs when both players have made at least 50 moves without a pawn move or capture, including illegal moves in the count. The chess rule that a game is a draw when checkmate is simply not possible is replaced by the (weaker) rule that the game is a draw when both players have left only a king, a king and a bishop, or a king and a knight.

6b. Resignations and agreements for a draw (As in chess, you can resign at any time.) At any time you can convey through the server a request that your opponent resign. The server will show your opponent the entire board for 30 seconds. At any time you can convey through the server an offer to end the game in a draw. The offer is open for 30 seconds.

7. Recovery time adjustments (The purpose of this rule is to protect you from incurring very long recovery times because your opponent forces you to move very fast just to keep up.) If your opponent is moving faster than you are and at the end of your move your opponent's total recovery time is more than a threshold amount, your men have their recovery times reduced by the excess. Your opponent is moving faster if he has made more moves than you have, or if you have both made the same number and your opponent's last move was before yours or had priority over yours. The threshold amount is four minutes, plus two minutes for each of your opponent's uncaptured men (a total of 36 minutes with all 16 men on the board, down to eight minutes with a king and one other man.), plus the amount of any earlier reductions. The reduction is applied first to your earliest recovering man, until it is fully recovered, then to the next earliest recovering man and so on. If two men are tied for earliest recovery, both are reduced by equal amounts.

8. Event time adjustments (The purpose of this rule is to prevent you from missing a critical deadline because you can not react in time to a move by your opponent or the recovery of one of your men.) When you see a move by your opponent, the server pauses the game clock for ten seconds, and then runs it at double speed for ten seconds to catch up. After you move, if the server has not paused the game clock (because your opponent did not see your move), it delays reporting new information to you as if it had. (So you can not tell whether your opponent saw your move, based on the timing of information from the server. This has no direct tactical effect on the game, because you can not move anyway during that period.) During the last ten seconds before your opponent can move again after a move you saw, the server reports your recoveries to you early (so that you can react to them without missing your "Just before opponent" deadline). The recoveries are reported as if the server were running the clock at double time for five seconds and then pausing it for five seconds during that period. The time of any move you make during that period is adjusted accordingly. A recovery by one of your men within five seconds before your legal move deadline is delayed until just before the next move, either by you or by your opponent if you can see it. (In this case you lose the benefit of the new information that the recovery would provide until after you have submitted your move. But the order of events is not affected by the delay.)

9. Precision and accuracy of times

The precision of all times and clocks is to the nearest second. The times of past moves and future scheduled recovery times refer to the time at the server, and are completely accurate to the indicated precision. The server will make reasonable efforts to ensure that each player's clock showing the current game time, and any timers counting down to future time points (for example, seconds until you can move again) are reasonably accurate. (They cannot be completely accurate because communications between the server and the players' computers are not instantaneous.) They are set ahead of the server's clock by the server's estimate of the time it takes for a submitted move to reach it (so that a move submitted as the clock ticks to 10:00 will arrive at about 10:00 server time).

10. Options related to real time play

The server may let the players change the rate of play by applying a scaling factor to all times in these rules, except for the precision of clocks. It may also let the players pause the game, or save it and restart it in a future session.

What is claimed is:

1. A method for enabling players to play a chess-like game, the method comprising:

providing a player with information about said game, where said information includes positions and types of game pieces on a) squares that are occupied by game pieces belonging to said player and squares that are diagonally adjacent thereto, b) squares to which one or more of said game pieces belonging to said player can move according to their respective movement patterns and which are not occupied by an enemy game piece and squares that are diagonally adjacent thereto, and c) squares occupied by enemy game pieces that can be captured or put in check by one or more of said game pieces belonging to said player according to their respective movement patterns, and where said information excludes positions and types of game pieces on any other squares; and upon performing a move of a particular game piece by said player to a new position, updating said information to account for said new position of said particular game piece yet temporarily excluding from said updated information, for a duration that depends on a rate of play of said player, positions and types of game pieces on certain squares.

2. The method of claim 1, wherein providing said information to said player comprises:

providing said player with an image of said game pieces on a game board arranged according to said information.

3. The method of claim 1, wherein said duration is given by a formula $D=2^x$, where D represents said duration, and $X=AN-BT-C$, where A, B and C are constant numbers, N represents the total number of moves made by said player in said game, and T represents the time that has elapsed since the start of said game.

4. The method of claim 1, wherein said certain squares are in a field of vision of said particular game piece, are not occupied by an enemy king and are not in a field of vision of another of said game pieces of said player for which a temporary exclusion of information does not apply.

5. The method of claim 1, further comprising:

if said duration has not yet expired before said particular game piece is captured, transferring any remaining portion of said duration to an uncaptured game piece of said player for which a temporary exclusion of information currently applies and, in the absence of such a game piece, applying said remaining portion of said duration to the next game piece of said player to have a temporary exclusion of information applied thereto.

6. The method of claim 1, further comprising:

enabling any of said players to make two or more consecutive moves in said game without an intervening move by another of said players;

delaying performance of a move by a particular player until at least a predetermined minimum period of time has elapsed since a most recent legal move by said particular player; and terminating said game at a loss to a specific player if more than a predetermined maximum period of time has elapsed since a most recent legal move by said specific player.

7. The method of claim 6, wherein said duration is given by a formula $D=2^x$, where D represents said duration, and $X=AN-BT-C$, where A, B and C are constant numbers, N represents the total number of moves made by said player in said game, and T represents the time that has elapsed since the staff of said game.

8. The method of claim 6, wherein said certain squares are in a field of vision of said particular game piece, are not occupied by an enemy king and are not in a field of vision of another of said game pieces of said player for which a temporary exclusion of information does not apply.

9. The method of claim 6, further comprising:

if said duration has not yet expired before said particular game piece is captured, transferring any remaining portion of said duration to an uncaptured game piece of said player for which a temporary exclusion of information currently applies and, in the absence of such a game piece, applying said remaining portion of said duration to the next game piece of said player to have a temporary exclusion of information applied thereto.

10. A computer-readable medium, having computer-executable instructions for performing steps comprising:

providing a player with information about a chess-like game, where said information includes positions and types of game pieces on a) squares that are occupied by game pieces belonging to said player and squares that are diagonally adjacent thereto, b) squares to which one or more of said game pieces belonging to said player can move according to their respective movement patterns and which are not occupied by an enemy game piece and squares that are diagonally adjacent thereto, and c) squares occupied by enemy game pieces that can be captured or put in check by one or more of said game pieces belonging to said player according to their respective movement patterns, and where said information excludes positions and types of game pieces on any other squares; and upon performing a move of a particular game piece by said player to a new position, update said information to account for said new position of said particular game piece yet temporarily exclude from said information, for a duration that depends on a rate of play of said player, positions and types of game pieces on certain squares.

11. The computer-readable medium of claim 10, wherein said duration is given by a formula $D=2^x$, where D represents said duration, and $X=AN-BT-C$, where A, B and C are constant numbers, N represents the total number of moves made by said player in said game, and T represents the time that has elapsed since the start of said game.

12. The computer-readable medium of claim 10, wherein said certain squares are in a field of vision of said particular game piece, are not occupied by an enemy king and are not in a field of vision of another of said game pieces of said player for which a temporary exclusion of information does not apply.

13. The computer-readable medium of claim 10, where the software program is further operative to having further computer-executable instructions for performing the steps of:

if said duration has not yet expired before said particular game piece is captured, transferring any remaining portion of said duration to an uncaptured game piece of said player for which a temporary exclusion of information currently applies and, in the absence of such a game piece, applying said remaining portion of said duration to the next game piece of said player to have a temporary exclusion of information applied thereto.

14. The computer-readable medium of claim 10, having further computer-executable instructions for performing the steps of:

enabling any of said players to make two or more consecutive moves in said game without an intervening move by another of said players;

delaying performance of a move by a particular player until at least a predetermined minimum period of time has elapsed since a most recent legal move by said particular player; and terminating said game at a loss to a specific player if more than a predetermined maximum period of time has elapsed since a most recent legal move by said specific player.

* * * * *